US005689962A

United States Patent [19]

Rafalovich

[11] Patent Number: 5,689,962

[45] Date of Patent: Nov. 25, 1997

[54] HEAT PUMP SYSTEMS AND METHODS INCORPORATING SUBCOOLERS FOR CONDITIONING AIR

[75] Inventor: Alexander P. Rafalovich, Indianapolis, Ind.

[73] Assignee: Store Heat and Produce Energy, Inc., Indianapolis, Ind.

[21] Appl. No.: 653,673

[22] Filed: May 24, 1996

[51] Int. Cl.[6] ..... F25D 17/06

[52] U.S. Cl. ..... 62/90; 62/324.1; 62/428; 62/506; 62/513

[58] Field of Search ..... 62/89, 90, 113, 62/173, 324.1, 324.5, 325, 404, 428, 506, 513

[56] References Cited

U.S. PATENT DOCUMENTS

| | | | |
|---|---|---|---|
| 2,241,070 | 5/1941 | McLenegan | 237/2 |
| 2,846,421 | 8/1958 | Pollock | 260/82 |
| 3,921,413 | 11/1975 | Kohlbeck | 62/90 |
| 3,991,936 | 11/1976 | Switzgable | 237/1 A |
| 4,030,312 | 6/1977 | Wallin et al. | 62/2 |
| 4,100,092 | 7/1978 | Spauschus et al. . | |
| 4,117,882 | 10/1978 | Shurcliff . | |
| 4,127,161 | 11/1978 | Clyne et al. . | |
| 4,256,475 | 3/1981 | Schafer . | |
| 4,270,518 | 6/1981 | Bourne . | |
| 4,283,925 | 8/1981 | Wildfeuer . | |
| 4,291,750 | 9/1981 | Clyne et al. . | |
| 4,393,918 | 7/1983 | Patry . | |
| 4,403,731 | 9/1983 | Katz . | |
| 4,462,461 | 7/1984 | Grant . | |
| 4,608,836 | 9/1986 | MacCracken et al. . | |
| 4,609,036 | 9/1986 | Schrader . | |
| 4,637,219 | 1/1987 | Grose . | |
| 4,645,908 | 2/1987 | Jones . | |
| 4,685,307 | 8/1987 | Jones . | |
| 4,693,089 | 9/1987 | Bourne et al. . | |
| 4,739,624 | 4/1988 | Meckler . | |
| 4,742,693 | 5/1988 | Reid, Jr. et al. . | |
| 4,753,080 | 6/1988 | Jones et al. . | |
| 4,807,696 | 2/1989 | Colvin et al. . | |
| 4,809,516 | 3/1989 | Jones . | |
| 4,893,476 | 1/1990 | Bos et al. . | |
| 4,909,041 | 3/1990 | Jones . | |
| 4,940,079 | 7/1990 | Best et al. . | |
| 5,036,904 | 8/1991 | Kanda et al. . | |
| 5,509,272 | 4/1996 | Hyde | 62/DIG. 2 |

FOREIGN PATENT DOCUMENTS

| | | |
|---|---|---|
| 188987 | 11/1982 | Japan . |
| 0060187 | 4/1984 | Japan . |
| 024384 | 10/1986 | Japan . |

OTHER PUBLICATIONS

V. Havelsky and K. Mecarik, "Heat Pump Design With Thermal Storage", *Heat Recovery Systems and CHP*, vol. 9, No. 5, pp. 447–450, 1989.

Powell Energy Products, Inc. "ISAC" brochure.

Electro Hydronic Systems, "Water Source Heat Pump Design Manual", (Apr. 1987) S.E.D. 13002.

J. Gregory Reardon, "Heating With Ice Storage — A Case Study".

Laura S. Adams, "Lennox Cool Thermal Energy Storage (CTES) A Direct Expansion Storage Module For Split System Air Conditioners".

Patrick L. Shive, "An Electric Heat Pump With An Off–Peak Electric Hydronic Based Backup System".

(List continued on next page.)

*Primary Examiner*—John M. Sollecito

*Attorney, Agent, or Firm*—Woodard, Emhardt, Naughton Moriarty & McNett

[57] ABSTRACT

Described are heat pump systems and methods for conditioning air, in which air is dehumidified including the steps of passage over an evaporator to cool and dehumidify the air, followed by passage over a subcooler to heat the air prior to passage into a space to be conditioned. Also described are heat pump systems and methods for conditioning air, in which air is heated by passage over a subcooler followed by passage over a condenser. The methods and systems are readily implemented and highly effective in improving system capacity.

7 Claims, 5 Drawing Sheets

OTHER PUBLICATIONS

York Applied Systems, "Ice Balls™0 Thermal Storage System".
C. William Uhr, Jr., "A 'Smart' Triple Function Storage System".
Cristopia Energy Systems, "STL Thermal Energy Storage Manual".
Gerald Best, "Phenix THP/3 Systems: Projected Utility Value".
Henry A. Courtright and Frank S. Mayberry,"Off–Peak Space Heating Systems".
Hassan E. S. Fath, "Heat Exchanger Performance For Latent Heat Thermal Energy Storage System".
Nurbay Gultekin, Teoman Ayhan and Kamil Kaygusuz, "Heat Storage Chemical Materials Which Can Be Used For Domestic Heating By Heat Pumps".
Zeki Z. Sozen, John R. Grace, and Kenneth L., Pinder, "Thermal Energy Storage By Agitated Capsules Of Phase Change".

HEAT PUMP SYSTEMS AND METHODS INCORPORATING SUBCOOLERS FOR CONDITIONING AIR

BACKGROUND OF THE INVENTION

The present invention relates generally to heat pump systems and methods and in particular to heat pump systems and methods which include subcoolers arranged for delivering heat to air to be used to condition a space.

As further background, air conditioners and heat pumps operating in a cooling mode extract heat from an indoor space and transfer it along with heat from the compressor to an outdoor space or another heat sink. As they cool, air conditioners also condense water vapor from the indoor air thus reducing humidity to comfortable levels.

It is widely recognized that the lower its temperature, the more moisture an evaporator coil will extract from the conditioned air. However, air leaving the evaporator has high relative humidity. Thus when initial humidity levels are high, the operation of the evaporator coil at a temperature effective to extract sufficient moisture from the conditioned air will result in uncomfortably cool conditioned air. In addition, the cooling capacity of the air conditioner must be increased to keep the evaporating temperature low enough for effective dehumidification, because of the high heat flux at moisture condensation.

To overcome this problem, supermarkets often use heaters to reheat conditioned air after its passage over evaporators. These heaters involve the use of "reclaimed" heat from condensers of the subject air conditioners or refrigeration equipment. In addition, in vehicular air conditioning systems, heat from the engine coolant is used to reheat conditioned air after passage over the evaporator. However, the use of such reheat strategies reducing relative humidity does not help to increase the cooling capacity of the air conditioner needed at high initial humidity levels. In addition, absolute humidity is still high. Also, "reclaimed" heat is not always available, e.g., in split residential and commercial systems, and the like.

Another solution involves using heat pipes for dehumidification. See, for example, U.S. Pat. Nos. 5,333,470 and 5,448,897. Such heat pipe dehumidification systems add to an evaporator two additional heat exchangers: one "precool heat pipe" is upstream of the evaporator and another "reheat heat pipe" is downstream of the evaporator. The heat pipes are connected to each other, and pump heat from upstream air to downstream air allowing usage of exceedingly low air temperature after the evaporator to cool the air before evaporator and simultaneously increase the air temperature after dehumidification and reduce relative humidity to a more comfortable level. Thus, heat pipes increase the cooling capacity of the system due to the passage of air of a reduced temperature through the evaporator. However, the installation and operation of heat pipe technology generally involves considerable capital expense. In addition, such systems lead to an excessive pressure drop in the conditioned air because there are two extra heat exchangers involved.

Another method which has been used for dehumidification is the absorption of moisture by a desiccant. After some time, the desiccant is regenerated by heating to an elevated temperature to desorb the moisture. Again, these methods generally involve relatively high capital and operating costs.

A long-recognized shortfall of heat pumps is their lack of heating capacity, especially in cold climate conditions.

To overcome this shortfall, low-efficiency resistance electric heaters are widely used, or where a gas furnace is available, it is operated at low ambient temperatures and the heat pump is shut down. Both electric resistance heaters and gas furnaces are relatively inefficient as compared to heat pumps. Thus, increasing heat pump capacity can lead to considerable savings in energy consumption.

SUMMARY OF THE INVENTION

One preferred embodiment of the invention provides a heat pump and air conditioning system for conditioning air including dehumidification. The system includes a compressor for compressing refrigerant, and a condenser for condensing refrigerant after exiting the compressor and transferring heat from the refrigerant to a heat sink. Also included is a subcooler for extracting heat from condensed refrigerant after exiting the condenser, and at least one evaporator for evaporating liquid refrigerant after exiting the subcooler. Means are provided in the system for moving air to be conditioned first against the evaporator and then against the subcooler. The system also includes a fluid path for returning refrigerant after exiting the evaporator to the compressor.

Another preferred embodiment of the invention provides a heat pump for conditioning air, which includes a compressor for compressing refrigerant and an outdoor heat exchanger which functions as a condenser in a cooling mode of the heat pump, and as an evaporator in a heating mode of the heat pump. The system includes first and second indoor heat exchangers, the first indoor heat exchanger functioning as a condenser in the heating mode and the second indoor heat exchanger functioning as a subcooler in the heating mode, and at least one fan operable in the heating mode to move air to be conditioned through said second indoor heat exchanger while functioning as a subcooler and then through said first heat exchanger while functioning as a condenser.

A further preferred embodiment of the invention provides a heat pump for conditioning air including dehumidification, including a compressor for compressing refrigerant, and an outdoor heat exchanger which functions as a condenser in a cooling mode of the heat pump and as an evaporator in a heating mode of the heat pump. First and second indoor heat exchangers are provided and connected in series, the first indoor heat exchanger functioning as a condenser and the second indoor heat exchanger functioning as a subcooler in said heating mode; and, the first indoor heat exchanger functioning as a subcooler and the second indoor heat exchanger functioning as a condenser in said cooling mode. At least one fan of the system is operable to move air to be conditioned through said second indoor heat exchanger and then through said first heat exchanger.

Still another preferred embodiment of the invention provides a method for dehumidifying air, which includes the steps of condensing refrigerant in a condenser, subcooling refrigerant after exiting the condenser in a subcooler, evaporating refrigerant after exiting the subcooler in an evaporator, passing a forced stream of the air against said evaporator wherein it forms a cooled and dehumidified air stream, and passing the cooled and dehumidified air stream against the subcooler wherein it is heated.

Still another preferred aspect of the invention provides a method for forming heated air for conditioning a space, which includes condensing refrigerant in a condenser, subcooling refrigerant after exiting the condenser in a subcooler, passing a forced stream of air against the subcooler to form a first heated air stream, and passing the first heated air stream against the condenser to form a second heated air stream.

Another preferred embodiment of the invention provides a method for conditioning air, which includes in a cooling mode the steps of condensing refrigerant in a condenser, subcooling the refrigerant after exiting the condenser in a subcooler, evaporating the refrigerant after exiting the subcooler in an evaporator, passing a forced air stream first against the evaporator and then against the subcooler, wherein it is cooled and dehumidified by the evaporator and then heated by the subcooler. In a heating mode, the method includes the steps of condensing refrigerant in a condenser, subcooling the refrigerant after exiting the condenser in a subcooler, and passing a forced air stream first against the subcooler and then against the condenser to form a heated air stream.

The systems and methods of the invention provide efficient means for dehumidifying conditioned air and increasing the heating and/or cooling capacity of air conditioning systems, including heat pump systems. Additional objects, features and advantages of the invention will be apparent from the following Description.

DESCRIPTION OF THE PREFERRED EMBODIMENT

Figure 1:
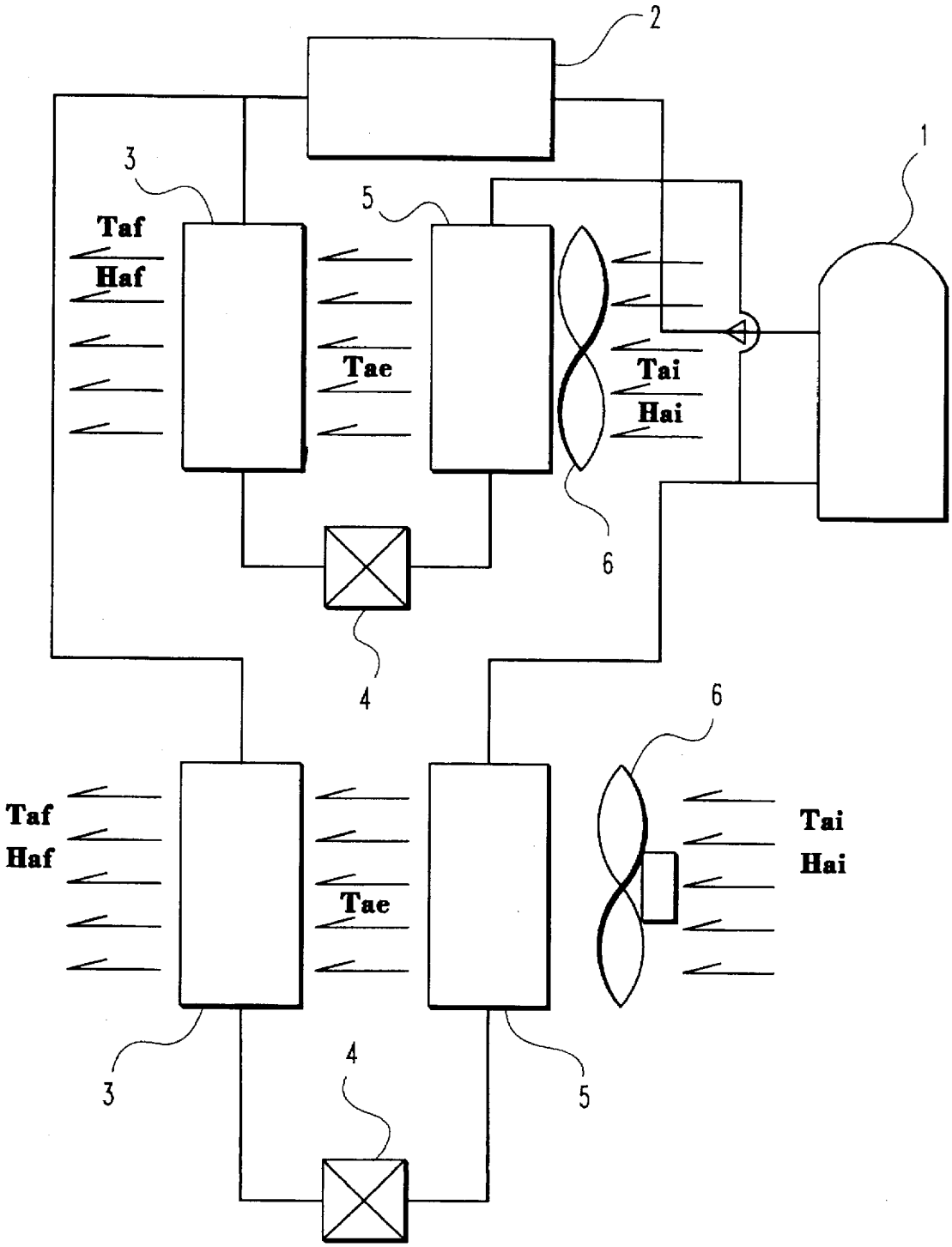
FIG. 1 is a diagrammatic view of one embodiment of an air conditioning system of the invention, including a subcooler operable to reheat conditioned air after passage over an evaporator.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIG. 1, shown is a diagrammatic view of a preferred air conditioning system of the invention, including a subcooler operable to reheat conditioned air after passage over an evaporator. In the system, refrigerant compressed in compressor 1 flows to condenser 2 where it liquefies and rejects heat. After condenser 2, hot liquid refrigerant passes to subcoolers 3 where it is cooled using air previously cooled by passage over evaporators 5. This forced air stream can be created by any suitable means, including for instance one or more fans or blowers 6. After exiting subcoolers 3, cooled liquid refrigerant is expanded in metering devices 4 and then flows to evaporators 5. The evaporation of the refrigerant in evaporators 5 absorbs heat from the conditioned air thereby both cooling and condensing moisture from the air. After exiting evaporators 5, the refrigerant flows back to compressor 1. After passage through the evaporators 5, conditioned air is forced against the outside surfaces of subcoolers 3 and thereby cools the liquid refrigerant and simultaneously absorbs heat from the refrigerant, leaving the conditioned air at a temperature higher than it was immediately after contact with the evaporators 5.

The following are illustrative data which may be achieved using systems such as that in FIG. 1.

| Refrigerant | W/Subcool According To Invention R22 | W/O Subcool Conventional R22 |
|---|---|---|
| $T_{LR}$, Temperature of liquid refrigerant leaving the condensor | 90° F. | 90° F. |
| $T_{SR}$, Temperature of liquid refrigerant leaving the subcooler | 58° F. | |
| $T_{ER}$, Refrigerant evaporating temperature | 42° F. | 45° F. |
| $T_{AI}$, Air initial (before evaporator) temperature | 80° F. | 80° F. |
| $H_{AI}$, Initial absolute humidity of air, $lb_{water}/lb_{dry\ air}$, Relative Humidity | .018 (.8) | .018 (.8) |
| $T_{AE}$, Temperature of air after evaporator | 47° F. | 50° F. |
| $T_{AF}$, Temperature of conditioned air | 58° F. | 50° F. |
| $H_{AF}$, Absolute Humidity of conditioned air, $lb_{water}/lb_{dry\ air}$, Relative Humidity | 0.068 (.66) | .0077 (1.0) |
| Cooling capacity at 45° F. evaporating temperature | 120% | 100% |

As we can see from the above data, subcooling increases cooling capacity 20% allowing the evaporating temperature to decrease. At the same time, the conditioned air has a higher temperature after subcooling. Thus, in accordance with the invention one may obtain multiple advantages as compared to conventional cycles. It will also be understood that a supplemental heater and/or heat reclaim may be used after subcoolers of the inventive systems, to further increase the temperature of the conditioned air.

Figure 2:
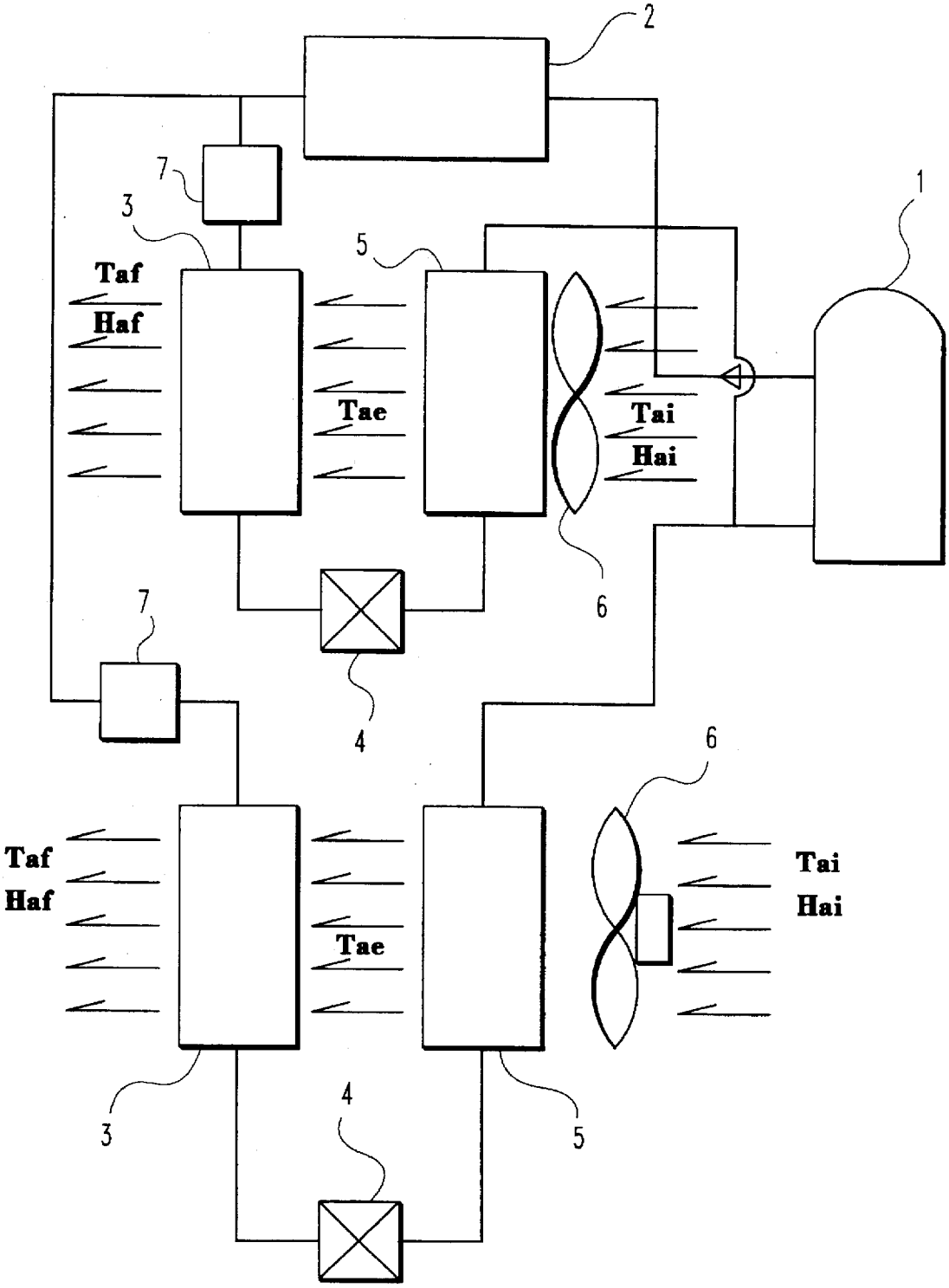
FIG. 2 is a diagrammatic view of another embodiment of an air conditioning system of the invention similar to that in FIG. 1, except including an additional pressure regulating device in the refrigerant line upstream of the subcooler.

The subcooler of FIG. 1 operates in a conventional manner, decreasing the temperature of liquid refrigerant after it exits the condenser. FIG. 2 shows a system which incorporates another way of cooling (supercooling) the refrigerant. In the system of FIG. 2, in addition to elements described in FIG. 1, there is a pressure reducing (expansion) device 7 positioned between the condenser and the subcooler. Device 7 may be a valve, an orifice, a capillary tube, a thermostatic expansion valve with a negative setting on its associated temperature sensor, it also may be incorporated in the other device, i.e., in a check-pro-rater, or in a check valve, etc. Device 7 operates to expand refrigerant after exiting the condenser to some predetermined pressure above the evaporating pressure. In this manner, subcooler 3 acts as a condenser, condensing refrigerant partly vaporized in the device 7 which in turn enhances heat transfer in the subcooler 3. The remainder of the cycle operates in the same fashion as that described in connection with FIG. 1 above.

Figure 3:
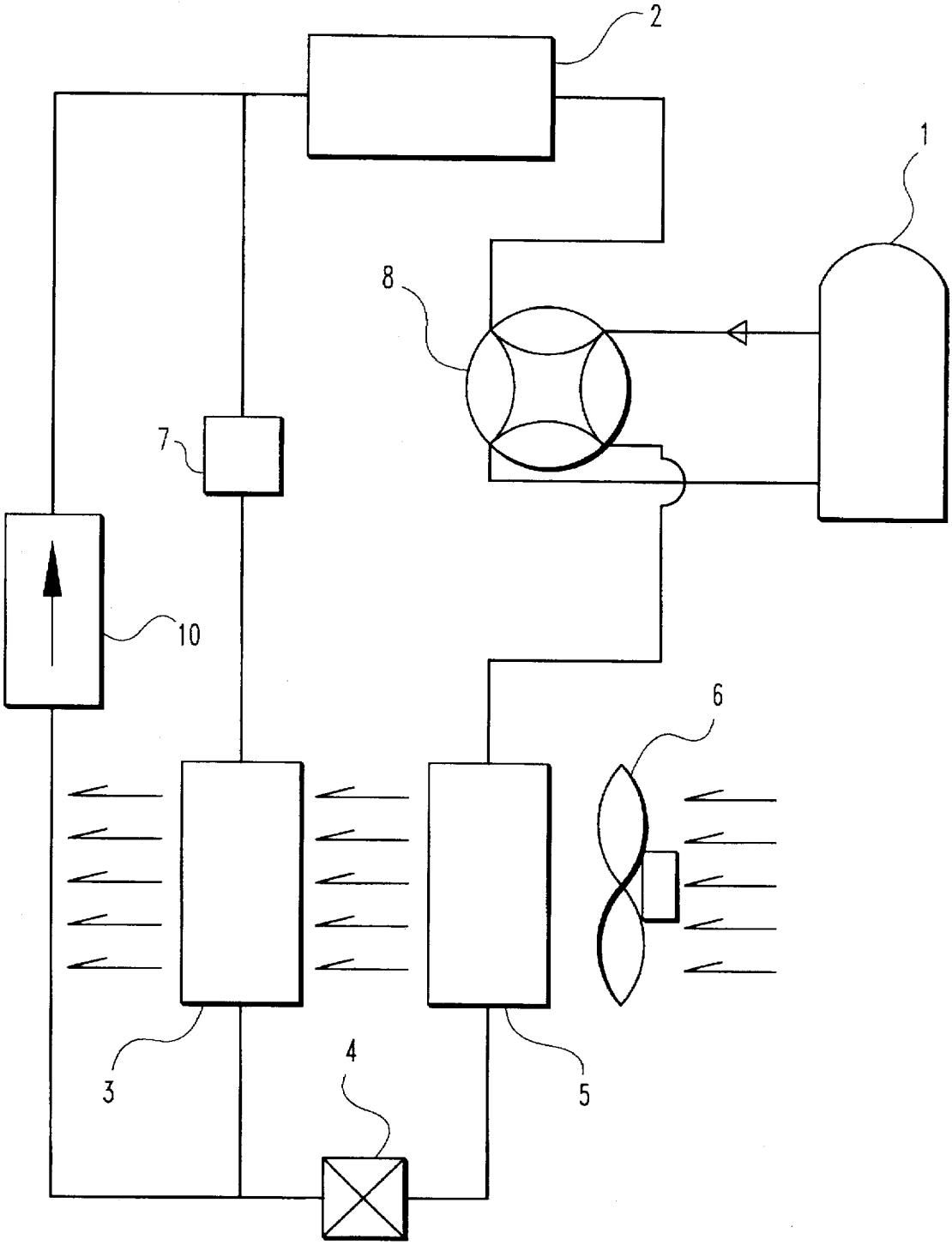
FIG. 3 is a diagrammatic view of another embodiment of an air conditioning system of the invention similar to those in FIGS. 1 and 2, including a subcooler in a heat pump operable in a cooling mode.

FIG. 3 illustrates an inventive heat pump system which incorporates a subcooler in dehumidification. The system of FIG. 3 includes elements similar to those in FIG. 1, and also includes a four-way valve 8, a bypass line 9 (for a heating mode), with a check valve 10, and an optional pressure reduction device 7 (depicted also in FIG. 2). Operation of heat pump in the cooling mode is analogous to operations for air conditioning systems described above.

Figure 4:
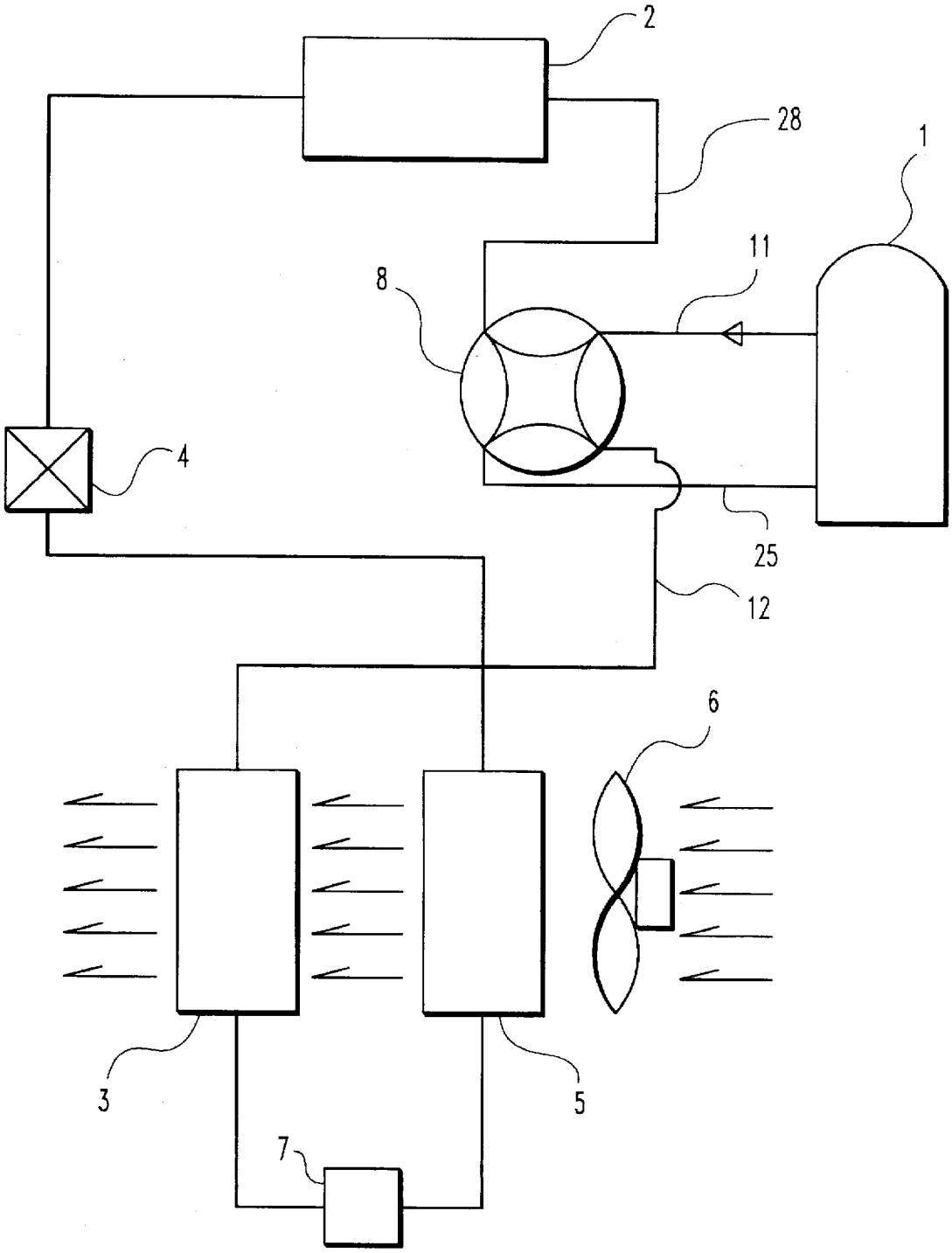
FIG. 4 is a diagrammatic view of a heat pump system of the invention employing subcooling to supplement a heating mode.

Referring now to FIG. 4, shown is a system in which subcooling is also used to increase the heating capacity of a heat pump (FIG. 4). Here, a subcooler 3 is installed upstream of a condenser 5. An optional pressure reduction device 7 in the flow path of the refrigerant between the condenser 5 and the subcooler 3 is provided. The other elements in FIG. 4 are analogous to those illustrated in FIGS. 1–3. In the heating cycle, a four-way valve 8 connects a discharge conduit 11 of a compressor 1 with a conduit 23, leading hot gaseous refrigerant to an inside heat exchanger 5 (now functioning as a condenser), and a suction conduit 25 to a conduit 23. After condensing in heat exchanger 5, liquid refrigerant flows through an optional pressure reduction device 7 to a subcooler 3 and further through a metering device 4 to an evaporator 2. Because the return air temperature is lower than temperature after the condenser, the subcooler preheats return air before it reaches the condenser. For example, if the return air temperature is 65° F. and the leaving (after condenser) air temperature is 90° F., the heating capacity and COP of the heat pump is increased by about 7–10%. This extra capacity is extracted from ambient as liquid refrigerant is subcooled.

Figure 5:
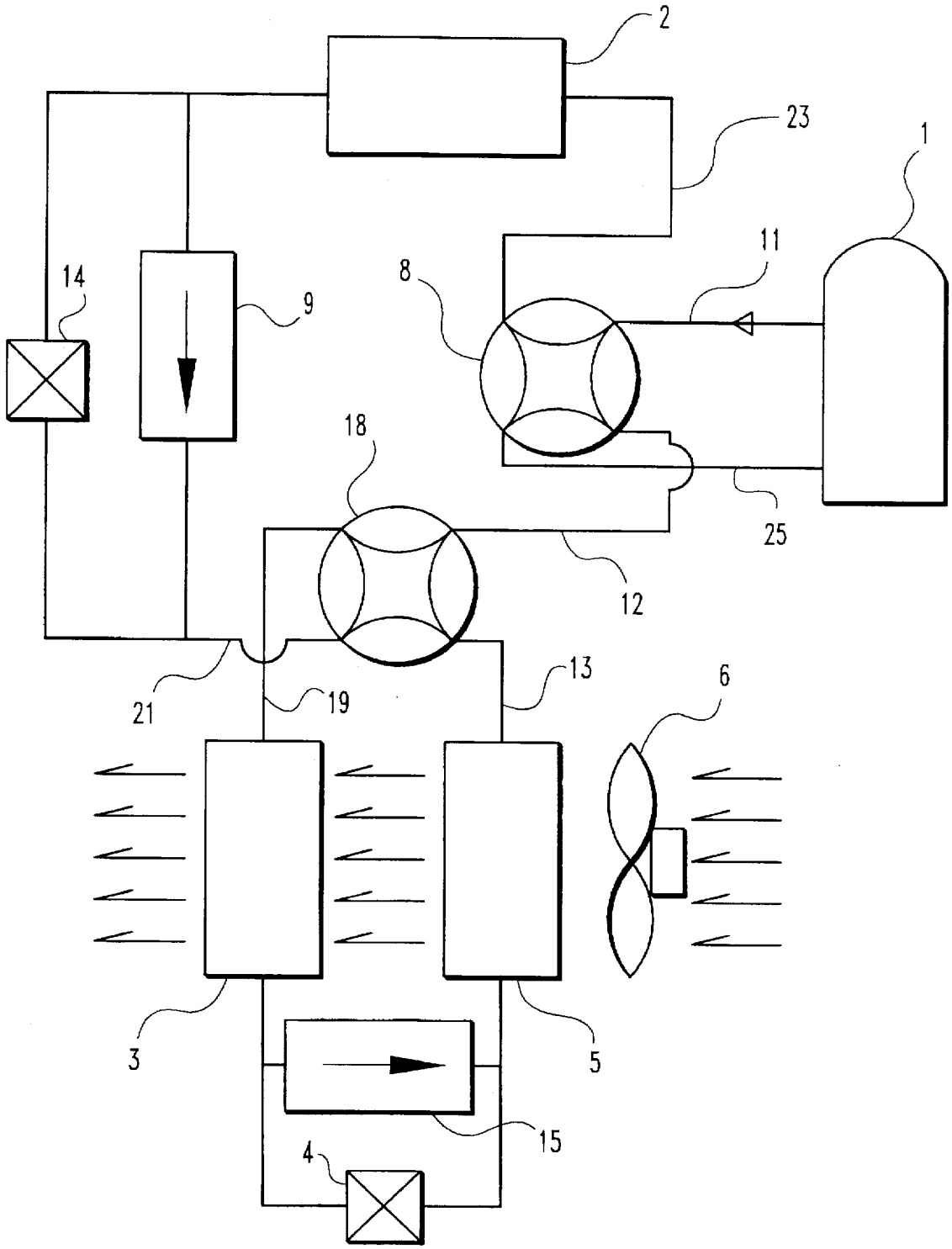
FIG. 5 is a diagrammatic view of a heat pump system of the invention employing subcooling to supplement operations in both cooling and heating modes.

Referring now to FIG. 5, shown is a system which utilizes subcooling for both dehumidification and increasing the heating capacity of a heat pump. Here, heat exchangers analogous to those which functioned in the systems of FIGS. 1–3 as a subcooler 3 and evaporator 5 are both indoor units. During the heating mode, a first four-way valve 8 connects a compressor discharge conduit 11 to a conduit 12 and a second four-way valve 18 connects conduit 12 to a conduit 19. Thus, heat exchanger 5 which functioned during the cooling cycle as an evaporator now functions as a subcooler, and heat exchanger 3 which functioned as a subcooler during the cooling cycle now functions as a condenser. Also included are two metering devices, 4 and 14, for example, thermostatic expansion valves, and two check valves 9 and 15. Orifices or capillary tubes may be used as metering devices. Also a check-flo-rater, i.e., the type used in Bryant's heat pumps, may substitute for both a check valve and a metering device also as a pressure reduction device between a condenser and a subcooler. During the heating mode, hot compressed refrigerant flows through both four-way valves 8 and 18, and conduits 11, 12 and 19, to heat exchanger 3 where refrigerant condenses. After condensing, warm liquid refrigerant passes through check valve 15, providing optional flow restriction to drop the pressure of refrigerant, and flows to heat exchanger 5 acting as a subcooler. Cold return air, moved by fan 6, picks up heat from subcooling (at heat exchanger 5) before impinging upon a condenser (heat exchanger 3). After subcooling in heat exchanger 5, liquid refrigerant passes through conduit 13, second four-way valve 18, and conduit 21, and flows to a metering device 14 where it is expanded. The refrigerant then flows to heat exchanger 2, now functioning as an evaporator. After evaporation, refrigerant flows through conduit 23, first four-way valve and conduit 25, and returns to compressor 1. The cooling mode operation of the system of FIG. 5 is analogous to those cooling modes described above. In this mode, the first four-way valve 8 connects conduit 11 with conduit 23, and conduit 12 with conduit 25. The second four-way valve 18 connects conduit 12 with conduit 13, and conduit 19 with conduit 21. It will of course be understood that other valving arrangements can be used to achieve the same functions. For example, because at any position of first four-way valve the second four-way valve has unambiguous position, both four-way valves can be substituted by a single six-way valve. Several other elements may be installed in air conditioning systems or heat pumps (FIGS. 1–5): i.e., a receiver between condenser and subcooler (not shown), a suction accumulator between evaporator and compressor (not shown), and so on.

While preferred embodiments of the invention have been described in some detail above, it will be understood that many modifications can be made to the illustrated systems without departing from the spirit and scope of the invention.

What is claimed is:

1. A heat pump and air conditioning system for conditioning air including dehumidification, comprising:

a compressor for compressing refrigerant;

a condenser for condensing refrigerant after exiting the compressor and transferring heat from the refrigerant to a heat sink;

a pressure reduction device for expanding refrigerant after exiting said condenser to a predetermined pressure above ana evaporating pressure of the refrigerant in the system;

at least one subcooler for extracting heat from condensed refrigerant after exiting the pressure reduction device;

at least one evaporator for evaporating liquid refrigerant after exiting the subcooler;

means for moving air to be conditioned first against said at least one evaporator and then against said at least one subcooler; and a fluid path for returning refrigerant after exiting said at least one evaporator to said compressor.

2. A heat pump for conditioning air, comprising:

a compressor for compressing refrigerant;

an outdoor heat exchanger which functions as a condenser in a cooling mode of the heat pump, and as an evaporator in a heating mode of the heat pump;

first and second indoor heat exchangers, the first indoor heat exchanger functioning as a condenser in the heating mode and the second indoor heat exchanger functioning as a subcooler in the heating mode;

at least one fan operable in the heating mode to move air to be conditioned through said second indoor heat exchanger while functioning as a subcooler and then through said first heat exchanger while functioning as a condenser.

3. A heat pump for conditioning air including dehumidification, comprising:

a compressor for compressing refrigerant;

an outdoor heat exchanger which functions as a condenser in a cooling mode of the heat pump and as an evaporator in a heating mode of the heat pump;

first and second indoor heat exchangers connected in series, the first indoor heat exchanger functioning as a condenser and the second indoor heat exchanger functioning as a subcooler in said heating mode; and, the first indoor heat exchanger functioning as a subcooler and the second indoor heat exchanger functioning as an evaporator in said cooling mode;

at least one fan operable to move air to be conditioned through said second indoor heat exchanger and then through said first heat exchanger.

4. A method for dehumidifying air, comprising:

condensing refrigerant in a condenser;

expanding refrigerant after exiting the condenser in a pressure reduction device to a predetermined pressure above an evaporating pressure of the refrigerant;

subcooling refrigerant after exiting the pressure reduction device in a subcooler;

evaporating refrigerant after exiting the subcooler in an evaporator;

passing a forced stream of the air against said evaporator wherein it forms a cooled and dehumidified air stream; and passing the cooled and dehumidified air stream against the subcooler wherein it is heated.

5. A method for forming heated air for conditioning a space, comprising:

condensing refrigerant in a condenser;

subcooling refrigerant after exiting the condenser in a subcooler;

passing a forced stream of air against said subcooler to form a first heated air stream; and passing the first heated air stream against the condenser to form a second heated air stream.

6. A method for conditioning air, comprising:

(i) in a cooling mode:

condensing refrigerant in a condenser;

subcooling the refrigerant after exiting the condenser in a subcooler;

evaporating the refrigerant after exiting the subcooler in an evaporator;

passing a forced air stream first against the evaporator and then against the subcooler, wherein it is cooled and dehumidified by the evaporator and then heated by the subcooler; and (ii) in a heating mode;

condensing refrigerant in a condenser;

subcooling the refrigerant after exiting the condenser in a subcooler; and passing a forced air stream first against the subcooler and then against the condenser to form a heated air stream.

7. A system for conditioning air operable in a heating mode and a cooling mode, the system comprising:

a cooling loop including:

a condenser for condensing refrigerant;

a subcooler for subcooling refrigerant after exiting the condenser;

an evaporator for evaporating refrigerant after exiting the subcooler;

means for moving air to be conditioned in the cooling mode first against the evaporator and then against the subcooler, wherein it is cooled and dehumidified by the evaporator and then heated by the subcooler;

a heating loop including:

a condenser for condensing refrigerant;

a subcooler for subcooling refrigerant after exiting the condenser;

means for moving air first against the subcooler and then against the condenser to form a heated air stream.

* * * * *

UNITED STATES PATENT AND TRADEMARK OFFICE

CERTIFICATE OF CORRECTION

PATENT NO. : 5,689,962

DATED : November 25, 1997

INVENTOR(S) : Alexander P. Rafalovich

It is certified that error appears in the above-indentified patent and that said Letters Patent is hereby corrected as shown below:

In col. 4, line 27 (the 2nd column of the table), please delete "0.068" and insert in lieu thereof —.0068—.

Signed and Sealed this

Twelfth Day of October, 1999

*Attest:*

Q. TODD DICKINSON

*Attesting Officer*

*Acting Commissioner of Patents and Trademarks*